US007959547B2

(12) United States Patent
Baumann et al.

(10) Patent No.: US 7,959,547 B2
(45) Date of Patent: Jun. 14, 2011

(54) CENTRIFUGE FOR CLEANING A LIQUID

(75) Inventors: Dieter Baumann, Greven (DE); Uwe Meinig, Bad Saulgau (DE)

(73) Assignee: Hengst GmbH & Co., KG, Muenster (DE)

( * ) Notice: Subject to any disclaimer, the term of this patent is extended or adjusted under 35 U.S.C. 154(b) by 585 days.

(21) Appl. No.: 12/158,243

(22) PCT Filed: Nov. 17, 2006

(86) PCT No.: PCT/EP2006/011033

§ 371 (c)(1),
(2), (4) Date: Jun. 19, 2008

(87) PCT Pub. No.: WO2007/079815

PCT Pub. Date: Jul. 19, 2007

(65) Prior Publication Data

US 2008/0296212 A1 Dec. 4, 2008

(30) Foreign Application Priority Data

Dec. 22, 2005 (DE) ..... 20 2005 020 012 U

(51) Int. Cl.
*B04B 9/06* (2006.01)

(52) U.S. Cl. ..... 494/49; 494/83

(58) Field of Classification Search ..... 494/24, 494/36, 43, 49, 64, 65, 67, 83, 84, 901, 5, 494/60, 31–34; 210/171, 232, 360.1, 380.1, 210/416.5; 184/6.24

See application file for complete search history.

(56) References Cited

U.S. PATENT DOCUMENTS

| | | | | |
|---|---|---|---|---|
| 2,750,107 | A | 6/1956 | More | |
| 3,432,091 | A * | 3/1969 | Beazley | 494/36 |
| 5,674,392 | A | 10/1997 | Christophe et al. | |
| 7,553,271 | B2 * | 6/2009 | Wiesmann | 494/49 |
| 7,713,185 | B2 * | 5/2010 | Baumann et al. | 494/49 |
| 2004/0157719 | A1 | 8/2004 | Amirkhanian et al. | |
| 2008/0296212 | A1 * | 12/2008 | Baumann et al. | 210/167.08 |

FOREIGN PATENT DOCUMENTS

| | | | |
|---|---|---|---|
| DE | 1105351 | | 4/1961 |
| DE | 102004005920 | A1 | 8/2004 |
| DE | 10344664 | A1 | 5/2005 |
| EP | 1782888 | A1 * | 5/2007 |
| JP | 2009167812 | A * | 7/2009 |

* cited by examiner

*Primary Examiner* — Charles E Cooley
(74) *Attorney, Agent, or Firm* — Greer, Burns & Crain, Ltd.

(57) ABSTRACT

The invention relates to a centrifuge for the cleaning of a liquid, in particular a lubricant oil of an internal combustion engine. Said centrifuge comprises a housing, at least one bearing element on the housing side and a rotor which is rotatably mounted thereon. The rotor is composed of at least two parts, an inner part for accommodating the bearing and a part for retaining impurities in an impurity collection zone, wherein said part may be detached from the inner part for maintenance of the centrifuge. The centrifuge is characterized in that the/each bearing element is an element composed of a first bearing material and comprises one or more first smooth bearing surfaces. The inner part, embodied as a single piece, is made of a second bearing material and provided with one or more second smooth bearing surfaces. First and second bearing surfaces cooperate directly among each other, and the first and second bearing materials form a pair of smooth bearing materials.

17 Claims, 3 Drawing Sheets

CENTRIFUGE FOR CLEANING A LIQUID

BACKGROUND OF THE INVENTION

This invention relates to a centrifuge for the cleaning of a liquid, in particular a lubricant oil of an internal combustion engine. The centrifuge comprises a housing, at least one bearing element on the housing side and a rotor which is rotatably mounted thereon. The rotor is composed of at least two parts, an inner part for accommodating the bearing and a part for retaining impurities in an impurity collection zone, wherein the retaining part may be detached from the inner part for maintenance of the centrifuge.

Centrifuges of the aforementioned type have basically been known for many decades and are used in various applications. One of these applications is the cleaning of lubricating oil of internal combustion engines. Especially in this application and also in many others, the centrifuge presents a machine component which, on the one hand, is to be producible as economically as possible and, on the other hand, have good efficiency and a high endurance limit.

To achieve good efficiency, the smoothest possible bearing of the rotor is essential; to this end, the known centrifuges use either smooth bearings or anti-friction bearings or combinations thereof. For this, the rotor of the centrifuge is mostly mounted by means of two such bearings on the bearing element on the housing side. When a bearing is designed as a smooth bearing, until now, at least one separately produced bearing sleeve is to be built into the centrifuge. The bearing sleeve must either be built onto the bearing element on the housing side or into the rotor; for example, it must be pressed on or in. For some smooth bearing constructions, two smooth bearing sleeves must even be built in, wherein one first smooth bearing sleeve is to be applied onto the bearing element on the housing side and a second smooth bearing sleeve must be built into the rotor. Then, the two smooth bearing sleeves together form the smooth bearing. Since two smooth bearings are usually used, a total of four bearing sleeves thus must be, in the extreme case, separately manufactured and then installed. If anti-friction bearings are alternatively used, they must also be separately manufactured and installed. It is obvious that the parts required for forming the bearings cause relatively high manufacturing and installation expenditures which, overall, has an appreciable effect on the production costs of the centrifuge.

SUMMARY OF THE INVENTION

Accordingly, this invention has the object of providing a centrifuge of the initially mentioned type which avoids the above presented disadvantages and can be produced with lower production and installation expenditures; this is to ensure, at the same time, high efficiency of the centrifuge with simple maintenance.

In accordance with the invention, this problem is solved with a centrifuge of the initially mentioned type which is characterized in that

- the/each bearing element on the housing side is an element composed of a first bearing material and comprises one or more first smooth bearing surfaces;
- the inner part, embodied as a single piece, is made of a second bearing material and provided with one or more second smooth bearing surfaces;
- first and second smooth bearing surfaces cooperate directly among each other; and
- the first and second bearing materials together form a bearing-fit pair of smooth bearing materials.

With the centrifuge according to the invention, the rotor is advantageously directly rotatably mounted on the bearing element on the housing side; in other words, without interposing smooth bearing sleeves or anti-friction bearings or other separate bearing components. With the centrifuge according to the invention, smooth bearing sleeves or anti-friction bearings or other such separate bearing components are no longer required for the bearing of the rotor. Accordingly, the expenditure connected with the manufacture and installation of the bearing sleeves or anti-friction bearings or other such separate bearing components is no longer required either—thus saving time and costs in the manufacture of the centrifuge. At the same time, however, high efficiency and a long life of the centrifuge are ensured because low bearing friction is achieved with low bearing wear even without separate bearing components—due to the use of suitable bearing materials which together form bearing-fit pairs of smooth bearing materials. With the known centrifuges, fits had to be produced for receiving the separate smooth bearings; for the centrifuge according to the invention, the same number of fits is produced for the direct bearing. Thus, the number of machining steps for the manufacture of fits remains the same and, in this respect, there is consequently no higher machining expenditure. However, omitted are all costs and installation steps for installing separate smooth bearings or anti-friction bearings or other such separate bearing components. Due to the solution according to the invention, the tolerance chains are advantageously smaller which results, in particular, in improved balancing and thus a higher speed of the centrifuge at unchanged drive power. Advantageously, the part for retaining impurities is connected with the inner part to the rotor; and the part for retaining impurities is separable for its disposal or cleaning from the inner part, while the inner part remains on the bearing element on the housing side. During maintenance of the centrifuge, the part for retaining impurities—with the impurities collected in it—can thus be removed from the housing and replaced by a fresh part for retaining impurities, while the inner part permanently remains in the centrifuge. During the maintenance process, the bearing of the rotor is thus not burdened in any way or exposed to any risk of contamination. As a result, the use of a more expensive material for the inner part is also justified since it is not replaced during the centrifuge maintenance but remains permanently in the centrifuge.

In a further embodiment of the invention, it is preferably provided that the inner part of the rotor is designed as a drive part with at least one nozzle arm extending radially outwardly, the arm having at least one recoil nozzle. In this embodiment of the centrifuge, the inner part is expediently a lifetime component of the centrifuge which, for this reason already, is made of a correspondingly durable material to ensure the necessary endurance limit. It is accordingly sufficient to select the suitable material for the inner part which forms a suitable pair of smooth bearing materials with the material of the bearing element on the housing side.

It is alternatively provided that the part for retaining impurities of the rotor is designed as a drive part with at least one recoil nozzle. In this embodiment of the centrifuge as well, the inner part is expediently a lifetime component of the centrifuge; thus, the advantages indicated in the preceding paragraph are here achieved as well. It is additionally advantageous to also use new recoil nozzles with every replacement of the part for retaining impurities.

To achieve the most economically possible production in large quantities, the inner part is expediently a part manufactured by casting from the second bearing material.

The invention preferably further proposes that, in the housing, an axis is provided protruding into the inner part or extending in the inner part and forming the bearing element on the housing side; and the inner part comprises a central tubular body which surrounds the axis. This embodiment results in a compact, clear and solid embodiment of the individual parts of the centrifuge.

Another contribution to an economical mass production of the centrifuge is that, preferably, the axis forming the bearing element on the housing side is a lathed or a lathed/milled part made of the first bearing material. The axis can thus be completely manufactured and machined in automatic machine tools, which allows a more economical production in large quantities.

A further embodiment proposes that, on the one hand, the axis forming the bearing element on the housing side is surface finished on its outer circumference and, on the other hand, the central tubular body is surface finished on its inner circumference in at least one area to at least one directly reciprocal bearing fit. In the area or the areas of the directly reciprocal bearing fit, the rotor is mounted on the bearing element on the housing side, e.g. the axis. The number and the arrangement of the areas of directly reciprocal bearing fits are oriented according to the marginal conditions of the corresponding case of application of the centrifuge—such as the axial length of the rotor; the mass of the rotor, and/or mechanical stresses acting from the outside on the centrifuge, such as the vibrations of an internal combustion engine or vibrations/shocks due to a moving vehicle.

Preferably, it is furthermore proposed that two areas spaced apart from each other in axial direction of the rotor are provided in a directly reciprocal bearing fit and that—in other areas—the outer circumference of the axis forming the bearing element on the housing side and the inner circumference of the central tubular body are at a radial distance from each other. The areas of the directly reciprocal bearing fit are expediently designed such that they are, on the one hand, as large as necessary to ensure an adequate endurance limit; and, on the other hand, that they are as small as possible to keep the machining expenditure low and to achieve the smoothest possible bearing of the rotor.

Preferably, a first area of the directly reciprocal bearing fit is furthermore provided on or near a first axial end of the rotor, and a second area of the directly reciprocal bearing fit on or near a second axial end of the rotor. The largest possible spacing of the areas of the directly reciprocal bearing fit provides for a relatively low burden of the individual bearing areas with given external conditions which contributes to a good endurance limit of the centrifuge.

Economical pairs of smooth bearing materials can generally be achieved by the bearing materials being metallic materials or plastic materials or plastic/metal composite materials.

In this respect, a more concrete material selection preferably provides that the first bearing material is a steel and that the second bearing material is an over-eutectic or under-eutectic aluminum/silicon alloy, or a bronze or bronze alloy. The bearing element on the housing side is then expediently made of steel and can be economically produced by machining a semi-finished part. The aluminum/silicon alloy or bronze or bronze alloy can be economically processed in pressure die-casting and is therefore expediently used for the die-casting production of the rotor or its inner part or its central tubular body.

In an alternative embodiment, the plastic/metal composite materials are plastics with embedded metal particles. These composite materials combine a low weight with good bearing properties and good stability.

To secure the rotor in axial direction during the centrifuge operation, it is preferably provided that the bearing element on the housing side and the inner part of the rotor have cooperating bearing elements for the axial bearing of the rotor on the bearing element.

A first development in this respect provided that the bearing elements for axial bearing of the rotor comprise an anti-friction bearing taking up axial forces. Actually, this anti-friction bearing must be separately built in; but it provides for a particularly low-friction and at the same time heavy-duty axial bearing of the rotor. The anti-friction bearing is not necessary per se for the rotor's rotatable mounting.

It is alternatively proposed that the bearing elements for the rotor's axial bearing are formed by at least one radially outwardly directed step on the bearing element and/or by at least one bearing element end piece having a radially outwardly extending collar and being connected with the bearing element. In this embodiment, pivot bearing as well as axial bearing are exclusively smooth for which simple and economical elements can be used.

Since the rotor is designed with the inner part and with the part for retaining impurities which is separable therefrom, the rotor's part for retaining impurities preferably consists partly or entirely of plastic. The use of plastic for the rotor's part for retaining impurities results in a lower total weight of the rotor and, moreover, after maintenance of the centrifuge, it allows an advantageously simple disposal of the impurities-laden part for retaining impurities because the suitable selection of that part's plastic material renders it completely thermally recyclable.

Likewise, for reasons of the lowest possible weight of the centrifuge and for realizing the lowest possible manufacturing costs, other parts of the housing which it comprises aside from the bearing element on the housing side can advantageously be made of plastic—either in parts or all of them.

Finally, it is provided in accordance with the invention that the bearing element on the housing side is hollow over at least one part of its axial length, and that—in the channel thus formed on the inside of the bearing element on the housing side—a minimum pressure valve is provided which releases a liquid flow through the centrifuge only when a minimum liquid pressure is exceeded. The minimum pressure valve is here space-savingly accommodated in a part of the centrifuge which can be easily burdened with even a higher liquid pressure—i.e. in the solid bearing element on the housing side.

BRIEF DESCRIPTION OF THE DRAWINGS

Exemplary embodiments of the centrifuge according to the invention are explained in the following with reference to a drawing. In the Figures of the drawing.

DETAILED DESCRIPTION OF THE DRAWINGS

Figure 1:
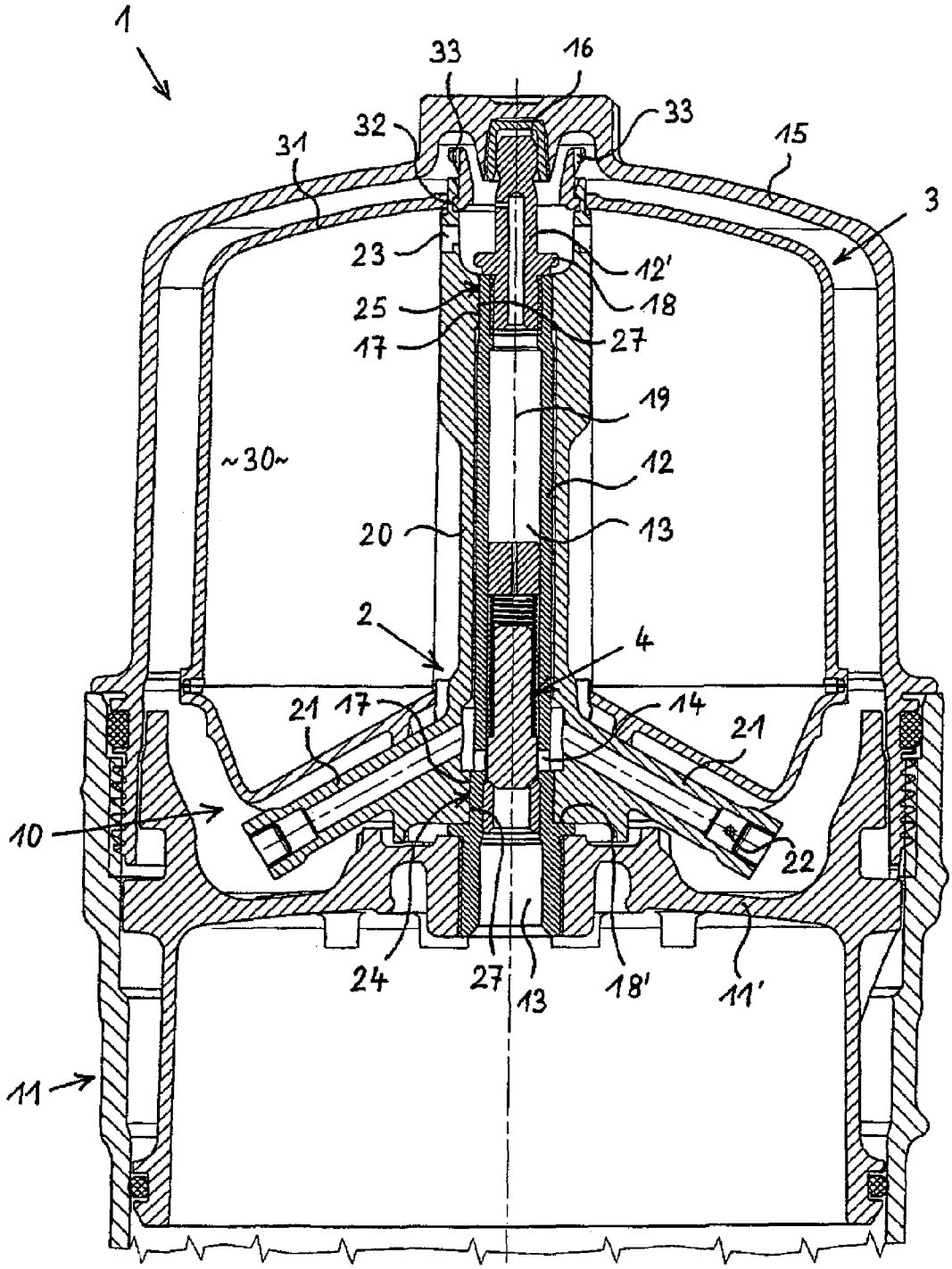
FIG. 1 shows a centrifuge in a first embodiment in longitudinal section.

As FIG. 1 of the drawing shows, the first exemplary embodiment shown of a centrifuge 1 has a housing 11 which has a hollow cylindrical basic form. The housing 11 is closed towards the top by a removable screw cover 15. On the inside of housing 11, a housing part 11' is provided—here pushed in—and subdivides the inside of the housing 11 into a lower and an upper area.

In the upper area, a rotor 10 of the centrifuge 1 is provided and rotatably mounted on a bearing element 12 on the housing side, in the form of an axis upwardly extending from the housing part 11'. For this, axis 12 at its lower end is connected—here screwed—with the housing part 11'. On axis 12, the rotor is rotatable about a rotation axis 19.

The upper end of axis 12 is formed by an upper axis end piece 12' which is screwed with the remaining axis 12 and which is, in turn, centrically supported with its upper end in a centering cavity 16 on the underside of the cover 15. Alternatively, an axis 12 freely projecting upwardly can, of course, also be used which has no central support on cover 15.

The rotor 10 of centrifuge 1 here comprises two parts, i.e. one inner part 2 and one part 3 for retaining impurities.

The inner part 2 essentially comprises of a central tubular body 20 which is arranged concentrically to axis 12 and surrounds it. From a lower area of the tubular body 20, two diametrically opposed nozzle arms 21 obliquely extend outwardly and downwardly in radial direction. On the radially outer end of each nozzle arm 21, one recoil nozzle 22 each is arranged for driving the rotor 10 by means of a liquid flow. Thus, the inner part 2 of the rotor 10 is its drive part.

In axial direction from the top, the part 3 for retaining impurities is pushed onto the inner part 2 and connected with it via connecting means 32 provided at the upper end of the rotor 10 so that any automatic relative movement in axial direction is excluded between the part 3 for retaining impurities and the inner part 2. Moreover, the inner part 2 of the rotor 10 and its part 3 for retaining impurities are designed such that the part 3 for retaining impurities is forced to move along with any movement by the inner part 2 in circumferential direction for which torque transmission means are used which are not shown in detail.

As further illustrated in FIG. 1 of the drawing, rotor 10 is directly mounted by means of its inner part 2 on the axis 12 forming the bearing element on the housing side—i.e. particularly without an intermediate layer of smooth bearing sleeves and/or anti-friction bearings. Smooth bearing sleeves or anti-friction bearings are no longer required here and accordingly need not be built into the centrifuge 1 during its production.

The bearing is here provided in two areas 24 and 25. The first area 24 is close to the lower axial end of the rotor 10 where the outer circumference of the axis 12 and the inner circumference of the tubular body 20 of the inner part 2 are each surface finished for a direct bearing fit. A second area 25 is close to the axial upper end of the rotor 10 where the outer circumference of the axis 12 and the inner circumference of the tubular body 20 are also surface finished for a direct bearing fit. In the areas 24 and 25, the outer circumference of the axis 12 has a first smooth bearing surface 17, and the inner circumference of the tubular body 20 has a second smooth bearing surface 27 directly fitting thereto.

A radial space exists in the areas between the outer circumference of the axis 12 and the inner circumference of the central tubular body 20 which are located outside of the bearing fit areas 24 and 25. This radial space is used as a channel for passing the liquid to be cleaned into the interior of the part 3 for retaining impurities.

In order to make the direct bearing sufficiently smooth and durable at the same time, suitable materials are used for the axis 12, on the one hand, and the central tubular body 20 or, respectively, the inner part 2, on the other hand; for example, a first metal or a first metal alloy on the one hand, and a second metal or a second metal alloy on the other hand which together form bearing-fit pairs of smooth bearing materials.

The exemplary embodiment according to FIG. 1 furthermore provides that the axis 12 is hollow and forms a channel 13 extending in axial direction. This channel 13 is provided with a minimum pressure valve 4 of a type known per se ad which only releases a liquid flow through the centrifuge 1 when a sufficient minimum liquid pressure is reached or exceeded, respectively.

A filter insert may be provided, for example, in the lower area of the housing 11 below the housing part 11'. The housing 11 can also be designed such that it only accepts the centrifuge 1.

In the assembled, operational condition of centrifuge 1 as shown in FIG. 1, the rotor 10 is directly rotatably mounted on the axis 12—thus, without an intermediate layer of smooth bearing sleeves and/or anti-friction bearings. The suitable materials used result in a smooth and durable bearing of the rotor 10 on the axis 12 even without such smooth bearing sleeves or anti-friction bearings.

To mount and secure the rotor 3 and its inner part 2 during operation of the centrifuge 1 in axial direction, corresponding axial bearing elements are used here. A first axial bearing element consists of a radially outwardly projecting collar 18 on the axis end piece 12'. The underside of the collar 18 forms a thrust face which the inner part 2 contacts in case of an upward axial movement. A second axial bearing element is formed by a radially outwardly projecting step 18' in the lower end area of the axis 12. This step 18' forms a contact surface for the lower face of the inner part 2 or, respectively, the central tubular body 20 whereby the axial mobility is limited towards the bottom.

From the bottom, a liquid flow passes in axial direction upwardly into the channel 13 in the axis 12 to the minimum pressure valve 4. If the liquid pressure is sufficiently high, the minimum pressure valve 4 opens and a first partial flow of the liquid passes—through radial openings 14 in the lower area of the axis 12—into the two nozzle arms 21 and through these into the two recoil nozzles 22. Comprising the inner part 2 and the part 3 for retaining impurities, the rotor 10 is thus made to rotate.

A second partial flow of the liquid flows upwardly through the annular gap between the outer circumference of the axis 12 and the inner circumference of the central tubular body 20 in axial direction and all the way through the upper bearing fit area 25. The bearing fit area 25 forms a throttle point for this second liquid flow. After the passage through the bearing fit area 25, this second liquid flow flows through radial openings 23 close to the upper end of the central tubular body 20 in radial direction from the inside to the outside into the interior of the part 3 for retaining impurities which forms an impurity collection zone 30. Radially inside and below, the cleaned partial liquid flow leaves the part 3 for retaining impurities and flows off by gravity together with the partial liquid flow exiting from the nozzles 22.

For the purpose of maintenance of the centrifuge 1, the cover 15 is unscrewed and removed. Using two gripping and operating elements 33 on the upper side of the cover wall 31 of the part 3 for retaining impurities, the latter can be detached from the inner part 2 and pulled off upwardly from the inner part 2 in axial direction. In reverse direction, a cleaned or new part 3 for retaining impurities can thereafter be pushed onto the inner part 2 and connected with it in a torsionally resistant manner in circumferential direction and detachably in axial direction. The centrifuge 1 is again ready for operation after setting on the screw cover 15. The inner part 2 serving as the drive part usually remains as a lifetime component in the centrifuge 1 and need not be removed from the centrifuge 1 for a replacement of the part 3 for retaining impurities. However, if needed, the inner part 2 can also be removed after removal of the upper axis end piece 12' and replaced by a new inner part 2 should it be possibly necessary against expectations.

The axis 12, on the one hand, and the inner part 2, on the other hand, comprise materials—e.g. metallic materials or composite materials—which together form bearing-fit pairs of smooth bearing materials. All other parts of the centrifuge 1 not involved in the bearing may consist of other materials without having to take any bearing suitability into account. The other material may be plastic, for example—thus realizing low weight and simple production. In its design made of plastic and with a suitable material selection, the part 3 for retaining impurities can then be thermally used together with the retained impurities without any individual metallic parts left behind.

Figure 2:
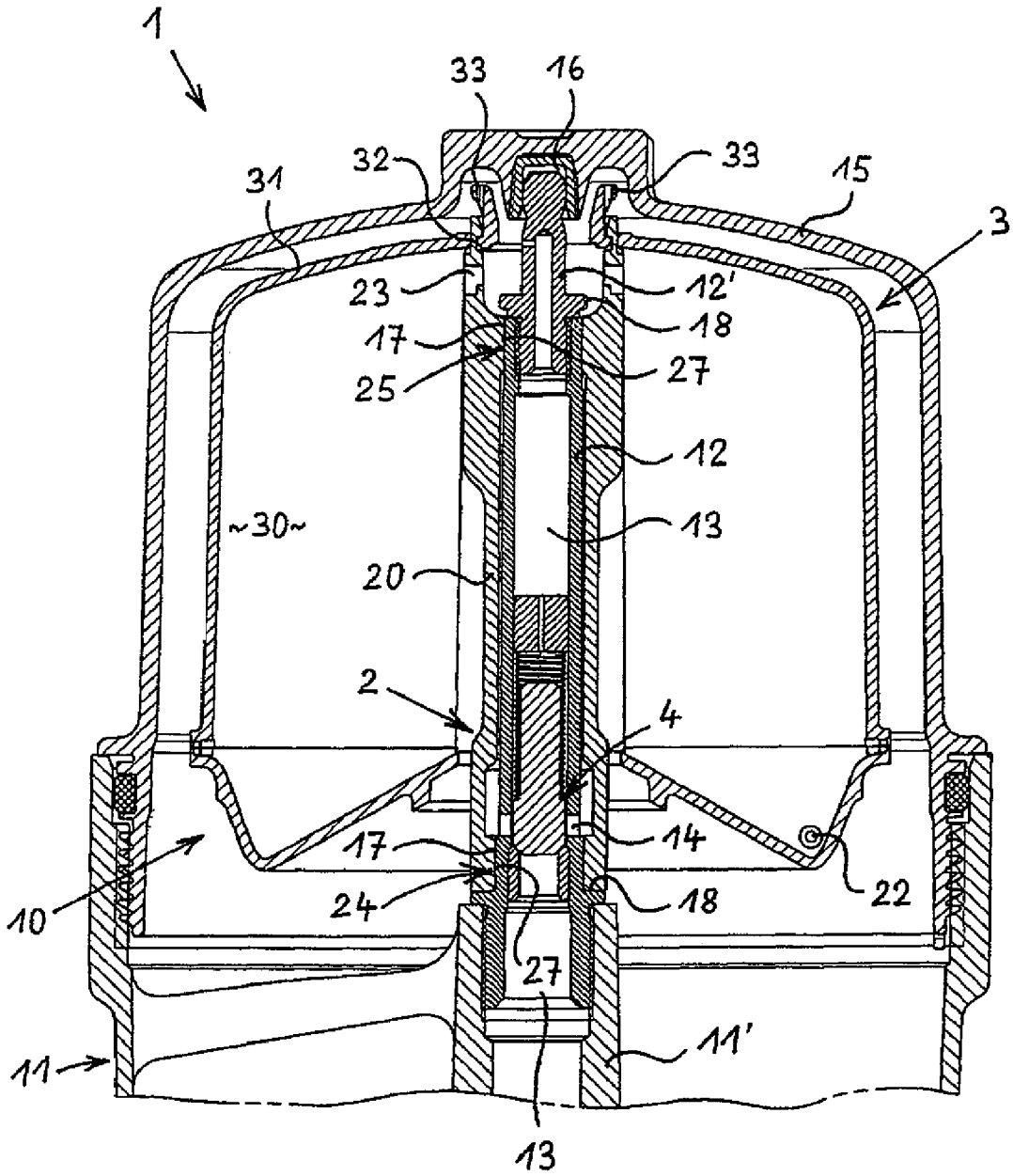
FIG. 2 shows the centrifuge in a second embodiment also in longitudinal section.

As a second exemplary embodiment, FIG. 2 of the drawing also shows a centrifuge 1 in longitudinal section, wherein the rotor 3 again comprises an inner part 2 and a part 3 for retaining impurities which is detachably connected with the inner part 2. The centrifuge 1 is provided in a housing 11 with screw cover 15, wherein the housing 11 here only accepts the centrifuge 1.

The difference versus the first exemplary embodiment according to FIG. 1 is, in particular, that the part 3 for retaining impurities now has two recoil nozzles 22 of which only one is visible in the sectional view according to FIG. 2. So the part 3 for retaining impurities here forms the drive part of the rotor 10.

The inner part 2 of the rotor 10 is here used for the bearing of the rotor 10 and the detachable mounting of the part 3 for retaining impurities.

The inner part 2 is here formed by a central tubular body 20 which has one smooth bearing surface 27 each on its inner circumference in the lower area and close to its upper end. In the corresponding areas on its outer circumference, an axis 12 which is here also inserted—here screwed in—into a lower housing part 11' is provided with one matching smooth bearing surface 17 each. Thus, the inner part 2 is here again directly mounted on the axis 12, i.e. without an intermediate layer of bearing sleeves or anti-friction bearings.

An axial bearing of the inner part 2 is provided downwardly by means of a radially outwardly projecting step 18 in the lower part of the axis 12. The mobility of the inner part 2 is axially limited upwardly by means of a radially outwardly projecting collar 18 on an axis end piece 12' screwed into the upper end of the axis 12.

In its further details shown in FIG. 2 and in its functions, the centrifuge 1 according to FIG. 2 is largely equivalent to the exemplary embodiment according to FIG. 1, and reference is made to the reference numbers and functions there explained.

Figure 3:
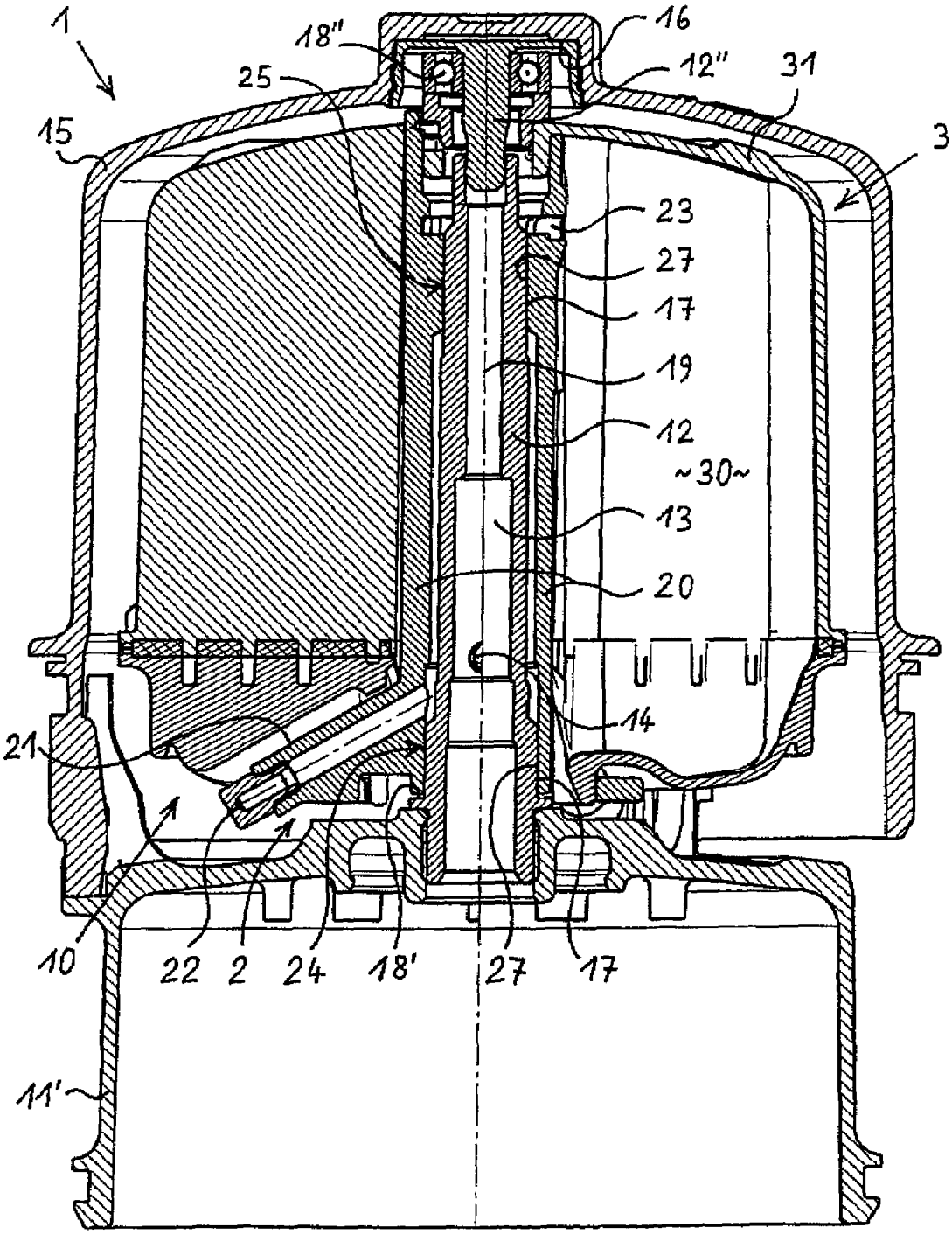
FIG. 3 shows the centrifuge in a third embodiment in longitudinal section.

FIG. 3 shows another centrifuge 1 as a third exemplary embodiment, again in longitudinal section. The center of FIG. 3 shows the axis 12 with its mounted central tubular body 20 of the inner part 2 of the rotor. To the left and to the right of the tubular body 20, the rotor's part 3 for retaining impurities pushed thereon is visible.

The top of FIG. 3 shows the central part of the cover 15 in which an axis centering insert 12" is held centeringly in a cavity 16 which is open toward the bottom. With the cover 15 set on, the axis centering insert 12" centeringly engages in the upper end area of the axis 12.

As opposed to the two previous exemplary embodiments, an axial anti-friction bearing 18" is here used for axial bearing of the inner part 2 in upwardly direction. The anti-friction bearing is set, with its inner ring, onto the axis centering insert 12". In the operation of the centrifuge 1, the inner part 2 thrusts with its upwardly directed face—which is provided in FIG. 3 underneath the lower face of the outer ring of the axial anti-friction bearing 18"- to the outer ring of the axial anti-friction bearing 18". The anti-friction bearing 18" takes up the axial forces with very low friction whereby the axial thrust of the inner part 2 upwardly against the anti-friction bearing 18" does not result in any appreciable deceleration of the rotor.

The inner part 2 is, here too, rotatably mounted via the smooth bearings already described beforehand—without the use of separate smooth bearing sleeves or similar components. One lower bearing fit area 24 and one upper bearing fit area 25 each are here again provided.

In its other details shown in FIG. 3 and in its functions, the centrifuge 1 according to FIG. 3 is largely equivalent to the exemplary embodiment according to FIG. 1, and reference is made to the reference numbers and the functions there explained.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A centrifuge for the cleaning of a liquid, in particular a lubricant oil of an internal combustion engine, said centrifuge comprising:

a housing;

at least one bearing element on the housing side and a rotor which is rotatably mounted thereon;

the rotor being comprised of at least two parts, an inner part for accommodating the bearing and a part for retaining impurities in an impurity collection zone;

said part for retaining impurities being detachable from the inner part for maintenance of the centrifuge;

each bearing element on the housing side being an element comprised of a first bearing material and comprising one or more first smooth bearing surfaces;

the inner part, formed as a single piece, being made of a second bearing material and provided with one or more second smooth bearing surfaces;

the first and second smooth bearing surfaces cooperating directly with each other, without an intermediate layer of smooth bearing sleeves or anti-friction bearings or other separate bearing components; and the first and second bearing materials together forming a bearing-fit pair of smooth bearing materials.

2. The centrifuge according to claim 1, wherein the inner part of the rotor is a drive part with at least one nozzle arm extending radially outwardly, said arm having at least one recoil nozzle.

3. The centrifuge according to claim 1, wherein the part for retaining impurities of the rotor is a drive part with at least one recoil nozzle.

4. The centrifuge according to claim 1, wherein the inner part is a part manufactured by casting from the second bearing material.

5. The centrifuge according to claim 1, wherein in the housing, an axis is arranged in the inner part and forms the bearing element on the housing side; and the inner part comprises a central tubular body which surrounds the axis.

6. The centrifuge according to claim 5, wherein the axis forming the bearing element on the housing side is at least partially lathe formed and made of the first bearing material.

7. The centrifuge according to claim 5, wherein the axis forming the bearing element on the housing side is surface finished on its outer circumference and the central tubular body is surface finished on its inner circumference in at least one area to at least one directly reciprocal bearing fit.

8. The centrifuge according to claim 7, wherein two areas spaced apart from each other in axial direction of the rotor are provided in a directly reciprocal bearing fit and wherein, in other areas, an outer circumference of the axis forming the bearing element on the housing side and an inner circumference of the central tubular body are at a radial distance from each other.

9. The centrifuge according to claim 8, wherein a first area of the directly reciprocal bearing fit is provided on or near a first axial end of the rotor, and a second area of the directly reciprocal bearing fit is provided on or near a second axial end of the rotor.

10. The centrifuge according to claim 1, wherein the bearing materials are selected from the group consisting of metallic materials, plastic materials and plastic/metal composite materials.

11. The centrifuge according to claim 10, wherein the first bearing material is a steel and wherein the second bearing material is selected from a group consisting of an over-eutectic aluminum/silicon alloy, an under-eutectic aluminum/silicon alloy, a bronze and a bronze alloy.

12. The centrifuge according to claim 10, wherein the plastic/metal composite materials comprise plastics with embedded metal particles.

13. The centrifuge according to claim 1, wherein the bearing element on the housing side and the inner part of the rotor have cooperating bearing elements for the axial bearing of the rotor on the bearing element.

14. The centrifuge according to claim 13, wherein the bearing elements for axial bearing of the rotor comprise an anti-friction bearing taking up axial forces.

15. The centrifuge according to claim 13, wherein the bearing elements for the axial bearing of the rotor are formed by at least one bearing element end piece having a radially outwardly extending collar connected with the bearing element.

16. The centrifuge according to claim 13, wherein the bearing elements for the axial bearing of the rotor are formed by at least one radially outwardly directed step on the bearing element and on the inner part.

17. A centrifuge for cleaning a liquid comprising:

a housing, at least one bearing element connected to the housing;

a rotor rotatably mounted on the bearing element;

the rotor comprising at least two parts, an inner part accommodating the bearing and a part retaining impurities in an impurity collection zone;

said part retaining impurities being detachable from the inner part during maintenance of the centrifuge;

each bearing element comprised of a first bearing material with one or more first smooth bearing surfaces;

the inner part, formed as a single piece, being made of a second bearing material and having one or more second smooth bearing surfaces;

the first and second smooth bearing surfaces cooperating directly with each other, without an intermediate layer of separate bearing components; and the first and second bearing materials together forming a bearing-fit pair of smooth bearing materials.

* * * * *